US005761813A

United States Patent [19]

Frick et al.

[11] Patent Number: 5,761,813

[45] Date of Patent: Jun. 9, 1998

[54] RAZOR DEVICE, IN PARTICULAR A THROW-AWAY RAZOR

[76] Inventors: Hans-Ruedi Frick, Austrasse 32, CH-8570 Weinfelden; Alfons Frei, Falkenweg 324, CH-5706 Boniswil, both of Switzerland

[21] Appl. No.: 812,323

[22] Filed: Mar. 5, 1997

Related U.S. Application Data

[63] Continuation of Ser. No. 244,965, Jul. 11, 1994, abandoned.

[30] Foreign Application Priority Data

Oct. 17, 1992 [DE] Germany ..... 9214029 U
Jan. 20, 1993 [DE] Germany ..... 43 01 378.3

[51] Int. Cl.[6] ..... B26B 21/44

[52] U.S. Cl. ..... 30/41; 30/535

[58] Field of Search ..... 30/41, 86, 90, 30/535, 537; 222/43, 309, 402.11, 402.13

[56] References Cited

U.S. PATENT DOCUMENTS

| | | | |
|---|---|---|---|
| 3,726,009 | 4/1973 | Hackmyer | 30/41 |
| 4,809,432 | 3/1989 | Schauble | 30/41 |
| 4,813,138 | 3/1989 | Chen | 30/41 |
| 4,868,982 | 9/1989 | McComas | 30/41 |
| 4,881,323 | 11/1989 | McGaughan | 30/41 |
| 5,016,351 | 5/1991 | Drahus | 30/41 |
| 5,070,611 | 12/1991 | Derin et al. | 30/41 |
| 5,133,130 | 7/1992 | Podolsky | 30/41 |
| 5,337,478 | 8/1994 | Cohen et al. | 30/41 |
| 5,564,190 | 10/1996 | Fleetwood | 30/41 |

FOREIGN PATENT DOCUMENTS

| | | | |
|---|---|---|---|
| 1217259 | 5/1960 | France | 30/41 |
| 2583672 | 12/1986 | France | 30/41 |
| 2631876 | 12/1989 | France | 30/41 |
| 561160 | 4/1957 | Italy | 30/41 |

*Primary Examiner*—Maurina T. Rachuba
*Attorney, Agent, or Firm*—Bachman & LaPointe, P.C

[57] ABSTRACT

In a razor device (10) with handle-like foam container (12) and a cap (22) which is releasable therefrom and which covers over a foam outlet valve (18), that is surrounded by a sliding guide ring (70), of the foam container (12) and is movable relative thereto, in the cap (22) at least two retaining noses (50, 50*a*) which are arranged on a common diameter are disposed as guide portions on both sides of a central projection (42) in substantially radially oppositely disposed relationship and can each be lowered into a slot (72) of the guide ring (70), wherein each slot (72) is separated by means of a radial bead from a guide surface of the guide ring (70). Each slot (72) can be flanked on both sides by a respective bead which is adjoined by a taper face with an upwardly inclined surface.

20 Claims, 4 Drawing Sheets

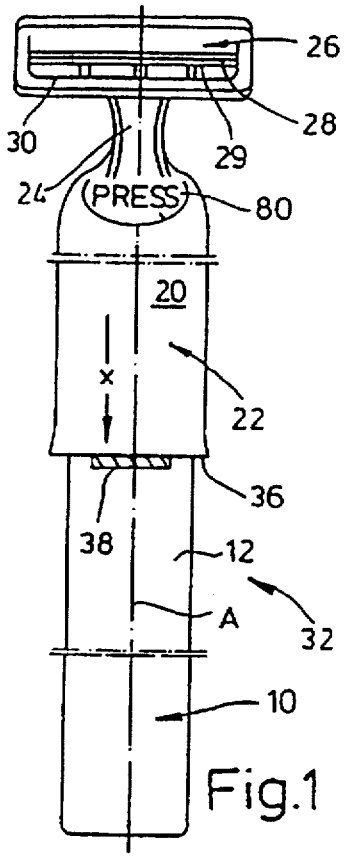
Fig.1
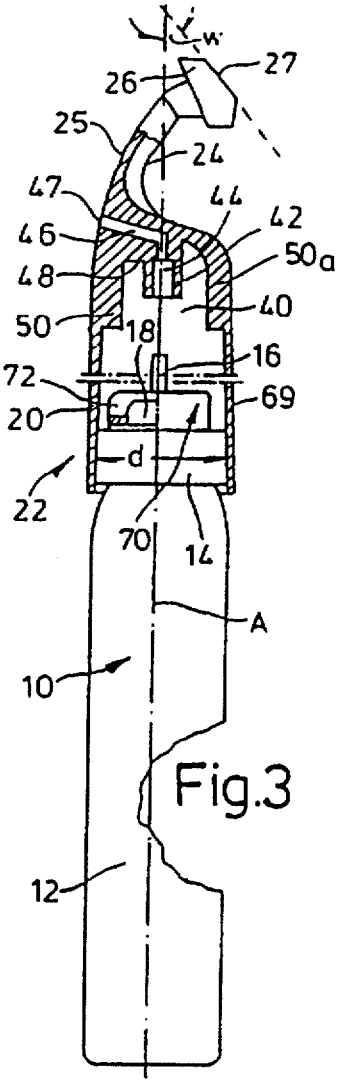
Fig.3
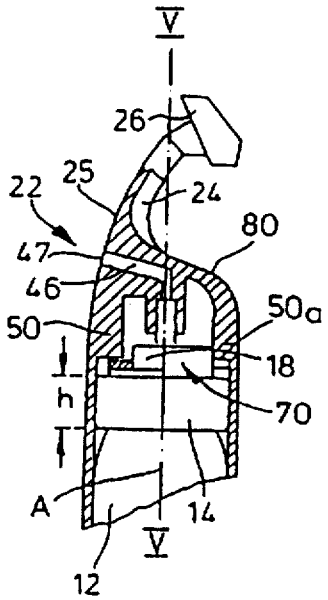
Fig.4
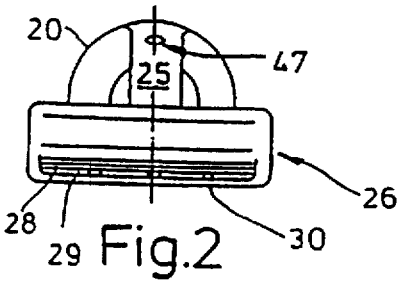
Fig.2
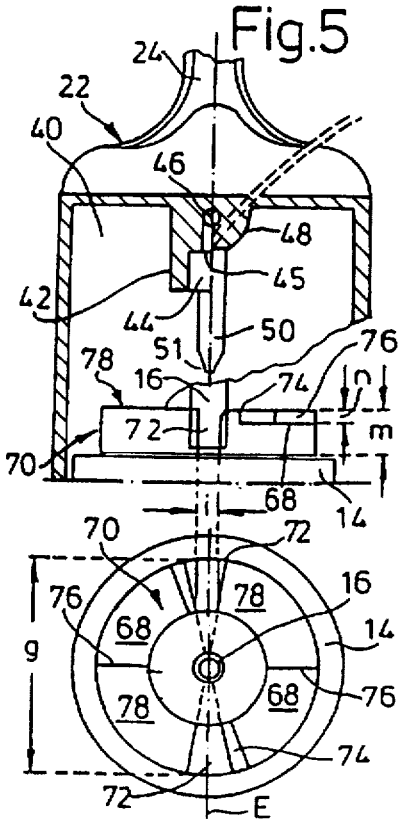
Fig.5
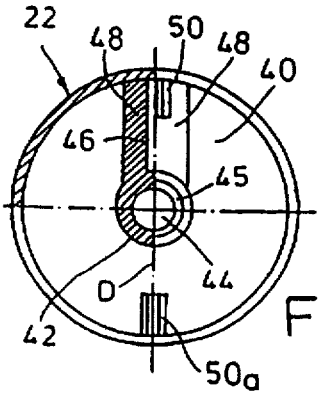
Fig.8
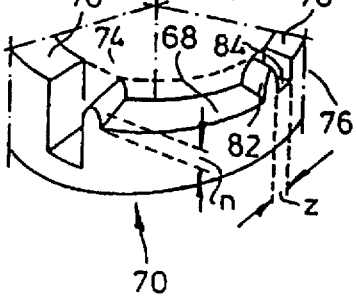
Fig.7
Fig.6

Fig.12
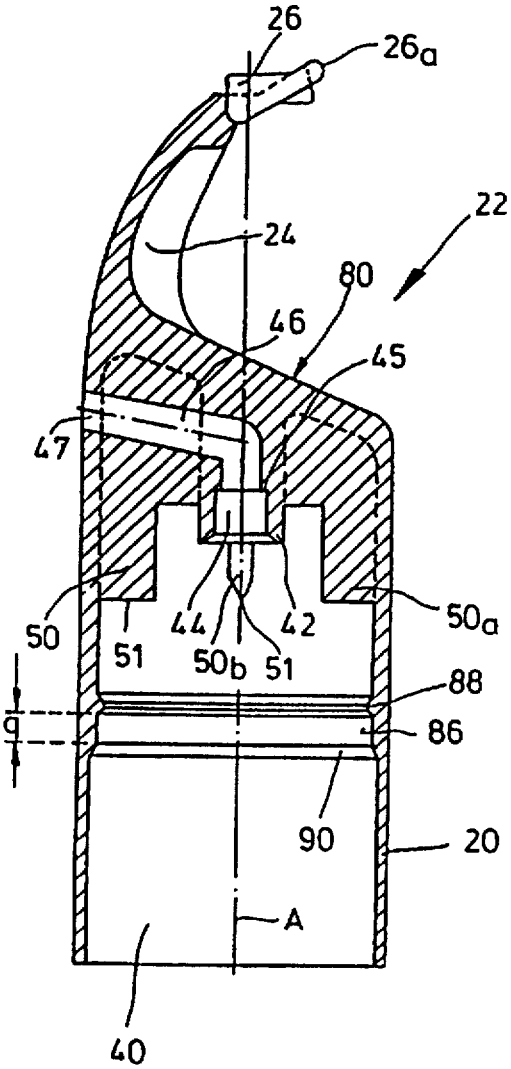
Fig.11
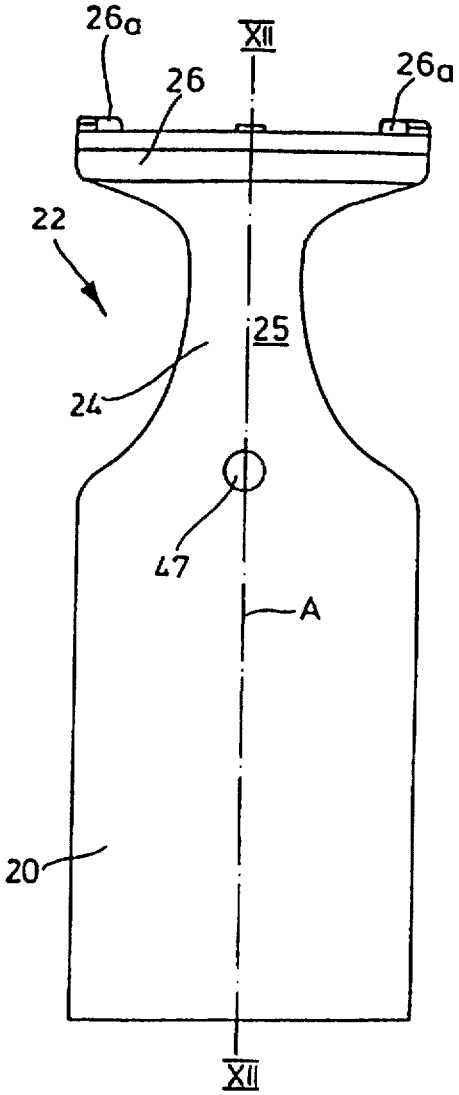
Fig.9
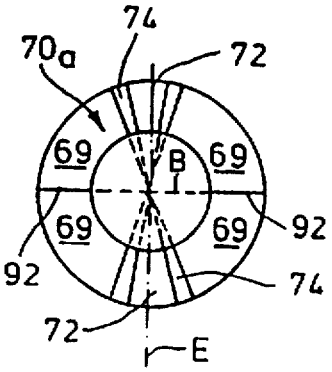
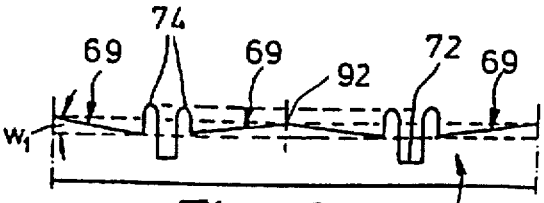
Fig.10

Fig.14
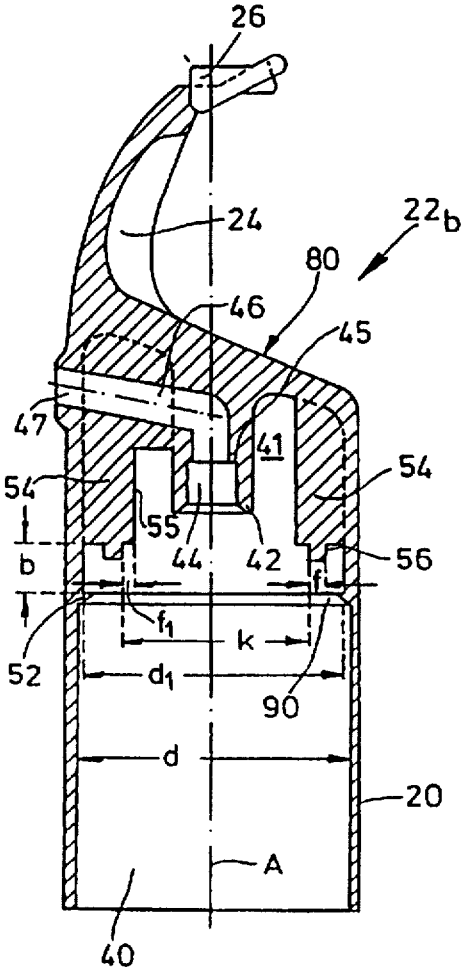
Fig.15
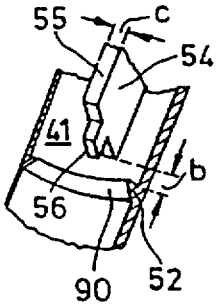
Fig.13
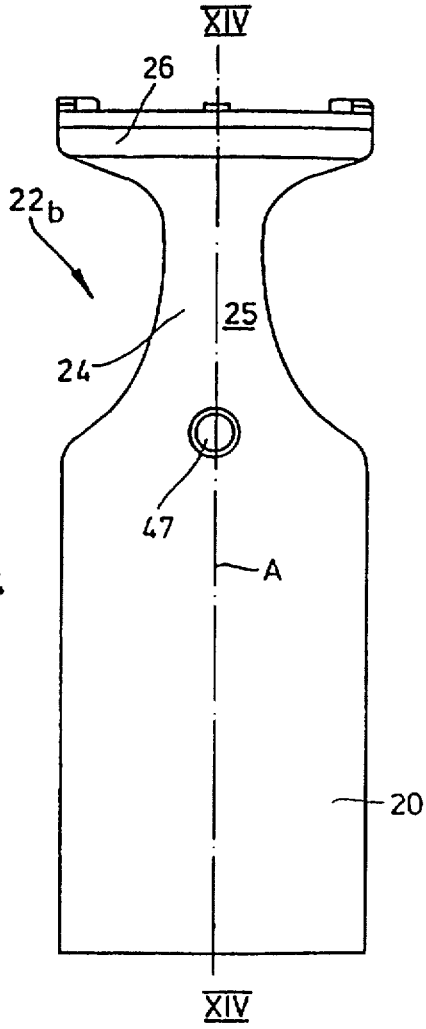
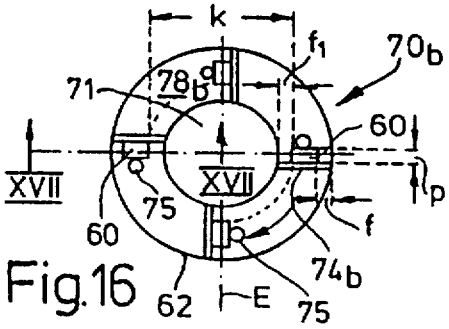
Fig.16
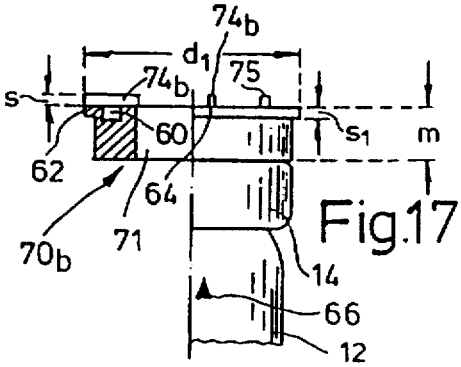
Fig.17

Fig.18
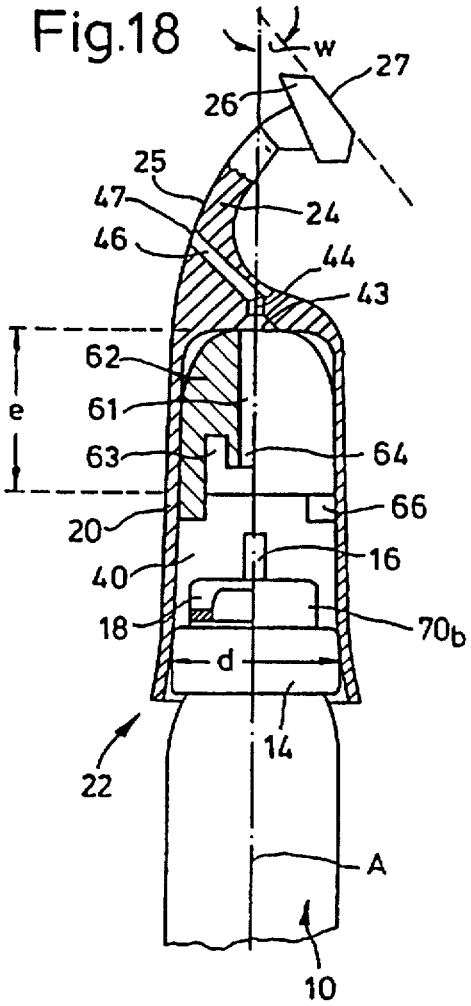
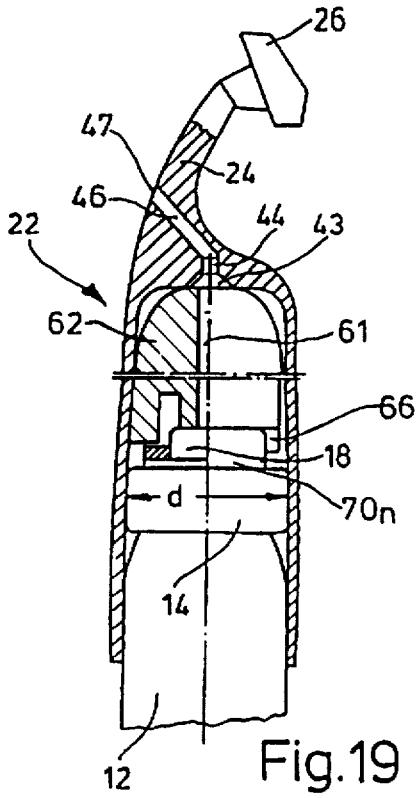
Fig.19
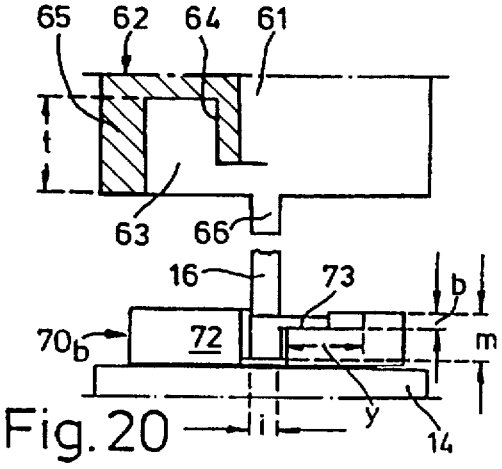
Fig. 20
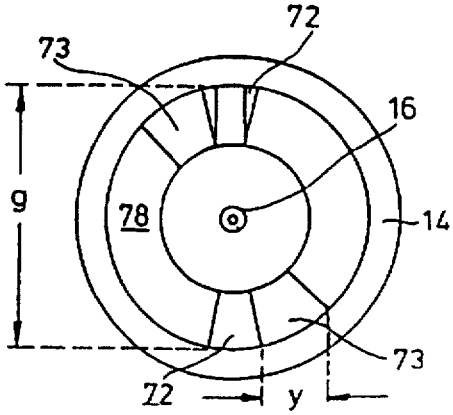
Fig.21

RAZOR DEVICE, IN PARTICULAR A THROW-AWAY RAZOR

This is a Continuation of application Ser. No. 08/244,965, filed Jul. 11, 1994, now abandoned.

The invention relates to a razor device, in particular a throw-away razor, as set forth in the classifying portion of the independent claim.

A razor device of that kind is to be found in European patent application No 0 322 486. In the arrangement disclosed therein, an internal fin of a cap is rotated on a collar around a central axis. A small rib which projects from the collar indicates the transition from a rearward transportation position into an actuation position following same. In the actuation position the internal fin of the cap rests on the guide surface and is moved into the foam position upon further rotary movement of the cap about the axis of the valve tube as far as the recess portion which is parallel to the axis.

In a razor device as shown in European patent specification No 101 767, the neck extends inclinedly relative to the axis of the valve tube, while the portion of the razor head, which engages the face of a user, is disposed outside an extrapolation of the cross-sectional prolongation of the handle portion and the cap fixedly engages into the handle portion in the form of a screw-type or snap-type fixing, so that the cap is not released from the handle portion during normal shaving operations. In order to extract the shaving foam a user must remove that cap from the elongate aerosol container which serves as the foam container, and re-fit it after the shaving operation.

In consideration of that state of the art and its deficiencies, the inventor set himself the aim of simplifying manufacture and handling of the razor device described in the opening part of this specification, and in particular improving the operational safety thereof.

That object is attained by the teaching set forth in the independent claims. Further advantageous configurations are set forth in the appendant claims.

In accordance with the invention, disposed in the cap is an insert with an axial flow passage and a central projection which is near the container and through which the flow passage passes, wherein the insert has an outer annular edge from which two retaining noses project in parallel relationship with the axis, which retaining noses can be lowered into slots in the sliding guide ring and thus into the foam position. In addition, it has been found desirable for the surface of the guide ring to define a transportation position of the retaining noses, and a respective shoulder surface between that surface and the slot to define a readiness position.

However, in accordance with the invention, in the cap at least two retaining noses are disposed as guide portions on both sides of the central projection in approximately radially oppositely disposed relationship and can each be lowered into a respective one of a plurality of slots in the guide ring; each of said slots is separated by means of a radial bead or projection from the guide surface of the guide ring and forms an obstacle which can be felt and heard, in the transition into the foam position; as a result, the user knows when he is at the threshold of the foam position and deliberately and consciously moves the cap into that position. The arrangement of the retaining noses and the slots ensures a safeguard against accidental tilting of the cap out of the axis of the device.

The feature that the guide surface for each retaining nose is provided with a retaining slot for fixing the retaining nose—and locking the cap—in a shaving position, is viewed as a further advantage in terms of handling of the razor device. The retaining slot is delimited by a threshold means which is formed out of the guide surface, and a step front face.

In a further embodiment of a sliding guide ring each of the slots is flanked on both sides by a pair of beads or projections; respective taper surfaces rise from each thereof so that at the side of the bead or projection, there is a very deep recess in which a retaining nose can be disposed.

For the purposes of guidance of the cap, it has also been found desirable for the retaining noses to decrease in respect of their cross-section towards their free edges so that they can be easily engaged into the co-operating retaining means.

Advantageously, the ratio of the spacing of the guide surface from the surface of the guide ring to the spacing thereof relative to the lowest part of the slot is to be about 1:5. The height of the bead or projection and/or the threshold means is to correspond to the spacing of that guide surface from the surface of the ring.

In accordance with a further feature of the invention a ratio of the arcuate length of the guide surface to the arcuate length of the ring surface disposed in front thereof is about 1:1 and/or a ratio of the arcuate length of the guide surface to the arcuate length of the ring surface disposed in front thereof is about 4:1.

A particularly advantageous configuration of the razor device of the general kind set forth is in accordance with the invention; in this case also, in the cap, at least two retaining noses are disposed as guide portions on both sides of the central projection in substantially radially oppositely disposed relationship. However they project peg-like at a spacing relative to the inside surface of the cap from radial flap portions formed thereon, in parallel relationship with the axis, and can each be lowered into a respective recess in the guide ring, the recesses being of corresponding cross-section and being closed towards the edge, wherein associated with each recess at one radial side is an abutment limb which sticks up from the surface of the guide ring; the retaining noses can be lowered into the recesses to produce the foam position.

In this embodiment an annular radial rib projects beyond the peripheral surface of the guide ring, the diameter of the annular radial rib approximately corresponding to the inside diameter of the upper cap portion which has the radial flap portions and which is separated by a retaining rib that projects towards the axis, from a sleeve-shaped lower cap portion of larger diameter.

In addition the height of the radial rib is to correspond to approximately a fifth of the height of the guide ring, while the height of the abutment limb approximately corresponds to the height of the radial rib.

Further advantages, features and details of the invention will be apparent from the following description of preferred embodiments and with reference to the drawings in which:

FIG. 1 is a front view of a two-part razor device with a shaving foam cartridge and a cap carrying a blade head, FIG. 2 is a plan view of FIG. 1, FIG. 3 is a view partly in section through FIG. 1 with the cap raised, FIG. 4 is a view in partial section through FIG. 1 showing transfer of the cap into a foam position, FIG. 5 is a view on an enlarged scale in partial section approximately along line V—V in FIG. 4 through the cap, FIG. 6 is a plan view of a sliding guide ring, FIG. 7 is a perspective view of a part of the guide ring, FIG. 8 is a view in an axial direction into the interior of the cap, FIG. 9 is a view approximately corresponding to FIG. 6 of another embodiment.

FIG. 10 is a diagrammatic view of a development of FIG. 9.

FIGS. 11 and 13 are rear views of two embodiments of the cap.

FIG. 12 is a view in section through FIG. 11 taken along line XII—XII therein.

FIG. 14 is a view in section through FIG. 13 taken along line XIV—XIV therein.

FIG. 15 is a perspective view of a part of FIG. 14.

FIG. 16 is a view of a further guide ring which is shown on a reduced scale in comparison with FIGS. 13 and 14.

FIG. 17 is a side view of FIG. 16, partly in section taken along line XVII—XVII therein.

FIG. 18 is a view in partial section corresponding to FIG. 3 showing a further embodiment.

FIG. 19 is a view in partial section corresponding to FIG. 4 with the cap in the foam position.

FIG. 20 is a side view of the FIG. 21 structure, and

FIG. 21 is a plan view of a detail on an enlarged scale from FIGS. 18 and 19.

A shaving foam cartridge 10 has, at the end, which is the upper end in the drawing, of its cylinder-like foam container 12, a collar 14 of a diameter d of about 20 mm and a height h of about 8 mm, from which a valve tube 16 of a valve 18 (not shown in greater detail) projects upwardly.

The cylindrical sleeve portion 20 of a cap 22 of limitedly flexible material, on which a neck 24 of U-shaped cross-section is formed, is fitted on to the shaving foam cartridge 10 which is substantially formed from rigid material. The neck 24 goes into a blade head 26 which extends transversely relative thereto and whose surface 27 is inclined at an angle w of about 40° towards the longitudinal axis A of the shaving foam cartridge 10, as shown in FIG. 3, and covers a double blade 28 whose shaving edge 29 extends at a small spacing relative to a protective limb 30 of the blade head 26. Here and in the other embodiments, the device may use both a rigid blade head 26 and also a so-called pivoting head.

In the transportation position of the two-part razor device 32 the cap edge 36, as shown in FIG. 1, bears against a parallel marking area 38 of the shaving foam cartridge 10 which, when the cap 22 is displaced in the pressing direction x, is covered over by same.

Provided in the cap interior 40 on the longitudinal axis A is a central projection 42 of the cap 22, with an axial passage 44 and a shoulder step 45 which can be seen therein. Extending from the axial passage 44 is an inclined passage 46 whose mouth opening 47 can be seen at the inclined back or outside surface 25 of the neck 24 or the cap portion adjoining same.

The inclined passage 46 is disposed in a shaped rib 48 of the cap 22, which—of semicircular cross-section—extends radially from the central projection 42 and carries a radial limb portion projecting from the rib a crest-like configuration, as a retaining or detent nose 50. The retaining nose 50 decreases or tapers in cross-section at its free edge 51 (see FIG. 5).

Disposed on the diameter D which is defined by the edge 51 is the edge 51 of a second retaining or detent nose **50*a* which is also shaped out of the cap 22**.

In the transportation position, the two retaining noses 50 and **50*a* rest on a guide surface 68 of a sliding guide ring 70 which surrounds the valve 18 around its valve tube 16 and is connected to the shaving foam cartridge 10. The guide ring 70 is provided, on a diameter E of a length g of 18 mm in this case, with two slots 72 which lie in plan view on the diameter E, being of an internal width i of about 3 mm, the slots being adjoined at one side by a bead or ridge 74, towards the guide surface 68. The guide surface 68 is delimited at the other end by a step front surface 76, above which is disposed the surface 78** of the ring.

If the height m of the ring 70 is for example 5 mm, then the spacing n of the guide surface 68 from the ring surface 78 is about 1.5 mm, with a maximum peripheral length of the guide surface 68 of nearly 20 mm.

During transportation, the retaining noses 50, **50*a* rest on the guide surface 68 and can be moved against the two beads or ridges 74 by rotating the cap 22 (clockwise direction in FIG. 6). Then, from that readiness position, the retaining noses 50, 50*a* are lowered into the slots 72 for the foam position, with a clear clicking noise on overcoming the obstacles, by a pressure being applied to a press surface 80. In the foam position the valve tube 16 is pressed downwardly by the shoulder step and opens the way for the foam to come out of the interior of the container; the foam passes through the passages 44, 46 to the mouth opening 47 and thus, passing through the neck 24, issues from the rear neck surface 25**.

The user takes that issuing shaving foam for his shave, moves the cap 22 into the transportation position thereof, and can then use the blade head 26 in the usual manner.

In an embodiment of the guide ring 70 which is only indicated in FIG. 7, at a spacing z from the step front faces 76 the ring may have threshold means 82 for respectively defining a respective retaining slot 84 which receives one of the retaining noses 50, **50*a***, to hold it in the shaving position.

The sliding guide ring **70*a* in FIGS. 9 and 10 has a respective bead or ridge 74 on each side of its slots 72; from the bead or ridge 74 a shallow taper surface 69 rises at an angle w1 to a central crest line 92. The pair of crest lines are disposed on a common diameter B. The taper surfaces 69 guide each of the retaining noses 50, 50*a* to the flank of a bead or ridge 74** against which they bear in holding relationship.

FIG. 12 shows a cap 20 with a blade head 26 which has lateral mounting arms **26*a* for a pivoting head. The cap 20 has in its interior 40 four retaining noses 50, 50*a*, as well as a stepped internal annular collar 86 of a width q, which is delimited upwardly by an annular rib 88 and downwardly by an inclined annular step 90**.

In the embodiment shown in FIGS. 13 and 14, the inclined annular step is the underneath surface of a retaining rib 52 which is shaped out of the cap **22*b* and above which the cap inside diameter d1 is shorter than the lower inside diameter d beneath the retaining rib 52. It extends at a small spacing b from a radial flap portion 54 of a thickness c, which is formed on the inside surface 41 of the cap and lies on a common diameter with a second radial flap portion 54. A retaining portion 56 of rectangular cross-section projects from the radial flap portion 54 in parallel relationship with the axis. The retaining portion 56 is arranged both at a spacing f from the inside surface 41 of the cap and also at a smaller spacing f1 from the inside edge 55 of the radial flap portion 54**.

Associated with those two peg-like retaining projections 56 of the cap **22*b*, in the sliding guide ring 70*b* which is fixed at the cartridge side, are two recesses 60 of corresponding cross-section, at the same radial spacing k; the recesses 60 are also disposed at a spacing f1 from the central recess 71 of the sliding guide ring 70*b* and at a spacing f relative to the peripheral surface 62 of a projecting radial rib 69 of the ring 70*b*; the diameter of the projecting radial rib 64** corresponds to the diameter d1 of the upper cap portion.

Extending at a radial side of the recess 60 of rectangular cross-section is a limb **74*b* which sticks up from the ring surface 78*b* and whose height s approximately corresponds to the height s1 (1 mm) of the radial rib 64**.

Each of the limbs 74 is displaced in parallel relationship by half the width of its recess 60 from its centre which is determined by the diameter. In addition, as shown in FIG. 16, the limbs 74 are disposed in the direction of rotation of the cap **22*b* as limiting means for the travel of the retaining portion 56** at the longitudinal side of the recess, which is remote therefrom.

Disposed at the other longitudinal side of the recess is a knob 75 which sticks up from the ring **70*b* and against which the retaining portion 56** audibly strikes during its rotary movement and over which it must be moved to go into the foam position.

In FIG. 16 there are two pairs of recesses 60 in order to simplify assembly of the ring **70*b*, that is to say matching of the diameter E to the marking 66 which in this case is in the form of an arrowhead and which indicates the location at which the cap 22*b* moves downwardly into the foam position after the retaining portions 56 have audibly struck against the limbs 74*b***.

As shown in FIG. 18 and the following Figures, disposed in the cap interior 40 on the longitudinal axis A is a funnel-like recess 43 which tapers inwardly in opposite relationship to the actuation direction x and in which the axial passage 44 of the cap 22 opens. Terminating beneath the recess 43 is an axial flow passage 61 of a cap insert 62 of a height e of about 20 mm with a part-spherical upper end and a lower annular recess 63 around a central projection 64 through which passes the axial flow passage 61 and whose axial length is shorter than the height t of an outer annular edge 65 of the cap insert 62 from which a pair of retaining noses 66 project downwardly on a diameter.

In the transportation position the retaining noses 66 rest on the surface 71 of a sliding guide ring 70 which surrounds the valve 18 and its valve tube 16 and which is connected to the shaving foam cartridge 10 (FIGS. 20 and 21). The ring 70 is provided on a diameter g of in this case 18 mm with two axis-parallel slots 72 of a width i of about 3 mm, each of which is adjoined by a respective shoulder 73. If the height m of the ring 70 is for example 5 mm, then the spacing b of the surface of the shoulder 73 from the ring surface 71 is for example 1 mm, with a maximum peripheral length y of the surface of the shoulder 73 of 5 mm.

During transportation therefore in this case also the retaining noses 66 rest on the ring surface 61 and can be moved into the actuation position by rotating the cap 22 (clockwise direction in FIG. 21) on to the shoulder surface 73. Then, from that actuation position, the retaining noses 66 are lowered into the slots 72 to give the foam position. In that position the valve tube 16 is pressed downwardly and opens the way for the foam to pass out of the interior of the container, the foam passing through the passages 61, 44 and 46 to the mouth opening 47 and thus, passing through the neck 24, issuing from the rearward neck surface 25.

We claim:

1. A razor device, comprising:

a foam container for use as a handle, said container including a foam outlet valve having a valve tube and a sliding guiding ring surrounding said foam outlet valve; and a cap having an axis and covering said foam outlet valve, said cap releasably attached to said container and movable relative to said container for creating a foam position and including a neck and a blade head, wherein said neck includes a mouth opening positioned on a back face of said neck and an insert positioned in said neck, said insert having an outer annular edge from which two retaining noses project parallel to said axis and having a central projection for insertion into said valve tube, said central projection including an axial flow passage therethrough which is in fluid communication with said mouth opening, wherein said guiding ring includes a guide surface means for forming a transportation position in conjunction with said retaining noses, a shoulder portion means for forming a readiness position in conjunction with said retaining noses prior to the creation of said foam position, and slot means for forming said foam position in conjunction with said retaining noses after said readiness position, said retaining noses positioned and sized for movement into said slot means for forming said foam position, wherein said guide surface means includes a retaining slot for at least one of said retaining noses for fixing said retaining noses in a shaving position, and wherein said retaining slot is delimited by a threshold means formed on said guide surface means and a front face of a step stepped relative to said guide surface.

2. The device according to claim 1, wherein said shoulder portion means includes means for indicating said readiness position.

3. The device according to claim 2, wherein said means for indicating comprises said shoulder portion means and said retaining noses positioned and sized for engaging, and generating an audible sound.

4. The razor device according to claim 3, wherein said shoulder portion means includes a ridge positioned adjacent said slot means for engagement with said retaining noses for generating said audible sound.

5. A razor device, comprising:

a foam container for use as a handle, said container including a foam outlet valve having a valve tube and a guiding ring surrounding said foam outlet valve, said guiding ring including a ring surface, a guide surface and a plurality of slots, wherein each of said plurality of slots is separated by at least one radial bead extending from said guide surface adjacent said each of said plurality of slots; and a cap releasably attached to said container and movable relative to said container for creating a foam position, said cap including a neck and a blade head, wherein said neck includes a mouth opening positioned on a back face of said neck and a central projection for insertion into said valve tube, said central projection including an axial flow passage therethrough which is in fluid communication with said mouth opening; and two retaining noses substantially oppositely disposed in said cap with said central projection positioned therebetween, and for use as guides, said retaining noses positioned and sized for movement into said slots over said at least one radial bead for forming said foam position, wherein said guide surface includes a retaining slot for at least one of said retaining noses for fixing said retaining noses in a shaving position, and wherein said retaining slot is delimited by a threshold means formed on said guide surface and a front face of a step stepped relative to said guide surface.

6. The device according to claim 5, wherein said retaining noses are disposed in a common line.

7. The device according to claim 5, wherein each of said plurality of slots is flanked by said at least one radial bead.

8. The device according to claim 7, wherein at least one tapered face having an inclined surface extends from one of said radial beads of one of said plurality of slots toward one of said radial beads of another of said plurality of slots.

9. The device according to claim 8, including more than one of said tapered faces and more than one of said radial beads, wherein an upwardly inclined relative to said foam container one of said tapered faces extends from at least one of said radial beads of said one of said plurality of slots and from at least one of said radial beads of said another of said plurality of slots for forming a radially extending crest line on said guide surface.

10. The device according to claim 9, wherein said upwardly inclined one of said tapered faces extends from each one of said radial beads of said one of said plurality of slots and from each one of said radial beads of said another of said plurality of slots for forming a plurality of crest lines disposed on a common line on said guide surface.

11. The device according to claim 5, wherein said retaining noses have free edges and are reduced in cross sectional area towards said free edges.

12. The device according to claim 9, wherein said radial bead has a height and said guide surface has a spacing (n) from said ring surface, and wherein said height is substantially equal to said spacing (n).

13. The device according to claim 5, wherein said guide surface has a first spacing (n) from said ring surface and said plurality of slots have a lowest surface having a second spacing (m) from said ring surface, wherein a ratio defined as first spacing (n) to second spacing (m) is 1:5.

14. The device according to claim 5, further including a shoulder surface defining an actuation position, wherein said shoulder surface has a third spacing (b) from said ring surface and said plurality of slots have a lowest surface having a fourth spacing (m) from said ring surface, wherein a ratio defined as third spacing (b) to fourth spacing (m) is 1:5.

15. The device according to claim 5, wherein said guide surface has an arcuate length and said ring surface has an arcuate length, wherein a ratio defined as the arcuate length of said guide surface to the arcuate length of said ring surface is one of 1:1 and 4:1.

16. A razor device, comprising:

a foam container for use as a handle, said container including a foam outlet valve having a valve tube and a guiding ring surrounding said foam outlet valve, said guiding ring including a guide surface and a plurality of recesses, wherein each of said plurality of recesses includes an abutment limb extending upwardly relative to said foam container from said guide surface on at least one radial side of said recesses; and a cap having an axis and releasably attached to said container and movable relative to said container for creating a foam position, said cap including a neck and a blade head, wherein said neck includes an inside surface having flap portions, a mouth opening positioned on a back face of said neck and a central projection for insertion into said valve tube, said central projection including an axial flow passage therethrough which is in fluid communication with said mouth opening; and two retaining noses substantially oppositely disposed in said cap with said central projection positioned therebetween, and for use as guides, said retaining noses projecting at a spacing from said radial flap portions and substantially parallel to said axis, wherein said retaining noses and recesses are positioned and sized for movement of said retaining noses in front of said abutment limbs and into said slots for forming said foam position, wherein said guide surface includes a retaining slot for at least one of said retaining noses for fixing said retaining noses in a shaving position, and wherein said retaining slot is delimited by a threshold means formed on said guide surface and a front face of a step stepped relative to said guide surface.

17. The device according to claim 16, wherein said retaining noses are positioned on a common line.

18. The device according to claim 16, wherein said guiding ring has a first height (m) and a peripheral surface and an annular radial rib of second height (s1) projects beyond said peripheral surface and said cap has an upper portion with a first inside diameter (d1) and a lower portion with a second inside diameter (d) larger than the first inside diameter (d1), said upper portion separated by a retaining rib which projects toward said axis from said lower portion, said annular radial rib having a third diameter substantially equal to said first inside diameter (d1), wherein said second height (s1) is substantially equal to a fifth of first height (m).

19. The device according to claim 18, wherein said abutment limb has a third height (s) substantially equal to said second height (s1) and each of said plurality of recesses has a width (p), and wherein said recesses are slot-like, said guiding ring further including at least one knob extending upwardly therefrom relative to said foam container, wherein at least one of the abutment limb and the knob is displaced a distance substantially half the width (p) from at least one of said recesses and substantially parallel to said at least one of said recesses on a common line (E).

20. The device according to claim 16, wherein said guiding ring includes at least one knob positioned opposite said abutment limb adjacent a longitudinal side of at least one of said plurality of recesses and wherein each of said plurality of recesses has a width (p), wherein at least one of said abutment limb and said knob is displaced substantially parallel to and at a distance of substantially half width (p) from said at least one of said plurality of recesses.

* * * * *